US006986526B2

(12) United States Patent
Haughlin

(10) Patent No.: US 6,986,526 B2
(45) Date of Patent: Jan. 17, 2006

(54) ARRANGEMENT COMPRISING A SKI BINDING AND A SKI BOOT

(75) Inventor: Bernt-Otto Haughlin, Royken (NO)

(73) Assignee: Rottefella A/S, Klokkarstua (NO)

( * ) Notice: Subject to any disclaimer, the term of this patent is extended or adjusted under 35 U.S.C. 154(b) by 67 days.

(21) Appl. No.: 10/297,879

(22) PCT Filed: Jun. 5, 2001

(86) PCT No.: PCT/IB01/00994

§ 371 (c)(1),
(2), (4) Date: May 6, 2003

(87) PCT Pub. No.: WO01/93963

PCT Pub. Date: Dec. 13, 2001

(65) Prior Publication Data

US 2003/0168830 A1 Sep. 11, 2003

(30) Foreign Application Priority Data

Jun. 8, 2000 (DE) ..... 100 28 359

(51) Int. Cl.
*A63C 9/02* (2006.01)

(52) U.S. Cl. ..... 280/613; 280/615

(58) Field of Classification Search ..... 280/614, 280/615, 613, 623, 625, 11.15, 11.224
See application file for complete search history.

(56) References Cited

U.S. PATENT DOCUMENTS 4,722,613 A 2/1988 Jungking
5,125,680 A * 6/1992 Bejean et al. ..... 280/615
5,190,309 A * 3/1993 Spitaler et al. ..... 280/615
5,671,941 A * 9/1997 Girard ..... 280/615
5,897,127 A 4/1999 Hauglin
5,924,719 A * 7/1999 Girard ..... 280/615
5,944,337 A * 8/1999 Girard et al. ..... 280/615
6,017,050 A * 1/2000 Girard ..... 280/615
6,209,903 B1 * 4/2001 Girard ..... 280/615

(Continued)

FOREIGN PATENT DOCUMENTS

DE 93 20 530.9 10/1994

(Continued)

*Primary Examiner*—Christopher P. Ellis
*Assistant Examiner*—Jeff Restifo
(74) *Attorney, Agent, or Firm*—Knobbe, Martens, Olson & Bear LLP

(57) ABSTRACT

A ski binding arrangement for cross-country or telemark binding, and a ski boot adapted thereto with a boot sole, such that the arrangement includes a first engagement element on the binding side and a second engagement element on the boot side in the region of the front end of the boot sole, which in the position for use are engaged with one another and keep the ski boot in linear or areal contact with a ski or a binding plate attached to the ski, wherein the underside of the boot sole in the front region is conversely curved in the long direction and the first and second engagement elements are adapted to one another such that, when the back end of the boot is raised or lowered, the boot sole makes a rolling motion associated with a longitudinal shift of the contact line or area on the ski or binding plate and, by a lowering or raising of the front end of the boot, e.g. movement in the direction opposite to that of the back end.

26 Claims, 16 Drawing Sheets

U.S. PATENT DOCUMENTS

| | | | | |
|---|---|---|---|---|
| 6,390,493 | B1 * | 5/2002 | Hauglin | 280/615 |
| 6,402,184 | B1 * | 6/2002 | Hauglin | 280/615 |
| 6,499,761 | B1 * | 12/2002 | Quellais | 280/623 |
| 2004/0164519 | A1 * | 8/2004 | Quellais et al. | 280/615 |
| 2004/0262886 | A1 * | 12/2004 | Girard | 280/615 |

FOREIGN PATENT DOCUMENTS

| | | |
|---|---|---|
| FR | 2 742 060 | 6/1997 |
| FR | 2 741 543 | 8/1997 |
| WO | WO 96/235558 | 8/1996 |

* cited by examiner

ARRANGEMENT COMPRISING A SKI BINDING AND A SKI BOOT

This application is a national phase entry in the United States of the international application PCT/IB01/00994 and claims the benefit of the German application Number 100 28 359.4 filed Jun. 8, 2000.

BACKGROUND OF THE INVENTION FIELD OF THE INVENTION

The invention relates to an arrangement comprising a ski binding and a ski boot adapted thereto, according to the precharacterizing clause of claim 1.

DESCRIPTION OF THE RELATED ART

Ski bindings of this kind are known in diverse designs. Their common feature is that a binding-side first engagement element, which is attached to the ski, can be brought into engagement with a second engagement element provided on the sole of a ski boot, so that the front end of the boot is fixed to the ski during cross-country skiing or downhill skiing in telemark style, whereas the back end (heel) of the boot can be raised substantially freely. Thus the first and the second engagement element together constitute a hinge joint that is basically rigid, in as much as it cannot be displaced in the long direction of the ski, and has an axis of rotation oriented substantially horizontally and perpendicular to the ski's long axis. The hinge joint or axle in question can be disposed either at the front end of the boot or somewhat further back, in the region of the toes or the ball of the foot. As an example in this regard, reference is made to the arrangement according to the patent FR 2 741 543. This construction, having a fixedly positioned hinge joint, is inconsistent with an anatomically optimal movement sequence, i.e. an anatomically optimal execution of the rolling motion made by a foot during locomotion on a flat substrate.

The same applies to a ski binding or arrangement such as is described, for example, in the applicant's patent WO 96/23558. In this design are provided, in addition to the above-mentioned first and second engagement elements in the region of the front end of the boot, a third and a fourth engagement element in the middle region, in particular at the back end of the front part of the boot sole; these serve to fix the boot additionally in this region and apply to it a pretensioning force directed toward the ski, which acts as a restoring force when the heel of the boot is raised.

This binding and similar designs likewise fail to achieve an anatomically optimal movement sequence as the ski boot (and the skier's foot) is rotated substantially as a unit about an axis of rotation near the tips of the toes, when the heel of the boot (and of the skier) is raised. Here, again, the hinge joint is rigid, i.e. cannot be displaced in the long direction of the ski. Such a rigid hinge joint is opposed to the natural movement when the foot is rolled on a substrate, and accordingly does not enable force to be optimally applied to the ski when pushing off.

SUMMARY OF THE INVENTION

The objective of the invention is thus to disclose an arrangement of this generic kind that is improved with respect to an anatomically and physiologically optimized movement sequence during skiing, and thus has better service ability properties.

This objective is achieved by an arrangement with the characteristics given in claim 1.

The invention includes the idea that the shapes of ski boot and binding are matched to one another in such a way that when the heel of the skier is raised (specifically for pushing off during cross-country skiing), the ball and toe region of the foot, or the region between toes and ball, makes an anatomically and physiologically correct rolling motion on the ski. It further includes the idea of constructing either the underside of the boot sole in the front region, and/or the surface of the ski or a binding plate that supports the front sole region, with a convex curvature in the long direction of ski or boot. This contour promotes a physiologically correct rolling motion when the heel of the boot, and hence of the skier, is raised. It is also within the scope of the invention that the fixation between binding and ski boot in the region of the front end of the boot is made movable in such a way as to enable a degree of movement of the front end of the boot in the direction opposite to the heel movement, e.g. to move down when the heel is raised and up when the heel is lowered. This is achieved by a special configuration of the first and second engagement elements (which are known per se) on the binding or boot in combination with third and fourth engagement elements in the region of the ball of the foot or base of the toes, the engagement elements being adapted to one another in such a way that the ski boot, specifically the front part of its sole, makes a kind of rocking movement on the ski or binding plate when the boot heel is raised and lowered, that is, the hinge joint between boot and binding is not rigidly fixed. The actual axis of rotation between the boot sole and the ski or binding can shift along the ski while the boot heel is raised or lowered. The result is an anatomically optimal movement sequence that corresponds to the externally unrestricted rolling of the foot during locomotion on a solid substrate.

With regard to structural details and embodiments reference is made to the subordinate claims.

In a first embodiment, in order to achieve the above-mentioned movement sequence while keeping the boot firmly fixed to the binding, on the first and/or second engagement element a first spring member is provided, which tends to force the front end of the boot sole toward the ski or the binding plate mounted thereon. This spring member is then associated with the first engagement element in the region of the slideway.

Preferably there is also associated with a third and/or fourth engagement element, which may be additionally provided, a (second) spring member which tends to force the sole of the boot toward the ski or binding plate. This is in particular constructed as a longitudinally elastic band or cable, which extends beneath the boot sole or runs along its side and provides an elastic connection between the fourth engagement element (and hence also the third engagement element, situated in the boot sole) to a fixation point on the ski or the ski binding. In another embodiment the band or cable is inelastic in itself and is endowed with resilience in the longitudinal direction by an additional spring element in the ski binding, in particular one that acts horizontally.

The engagement elements in the boot sole, i.e. the second and the third engagement element, in an advantageous embodiment that regarding the second engagement element is known per se, are each constructed as an axle that extends transverse to the median plane of the boot, and hence to the long axis of the ski, and in particular are made of steel. This axle is enclosed by the associated first or fourth engagement element, respectively, which extends around the axle like a hook.

To produce a restoring force that tends to drive the boot sole back into the "normal" position, i.e. with the heel of the boot resting on the ski or binding plate, in a manner that is advantageous with respect to movement dynamics, behind the first engagement element on the ski side, or behind the second engagement element on the boot side, an elastically compressible counterpressure element (flexor) is provided. This is disposed in particular between the engagement regions at the front end and in the middle region of the boot sole, and in a simple, economical and durable embodiment is constructed as an elastomer block. So that its function will not be impaired by accumulated snow, it is preferably provided with a ridged or cleated profile. Preferably the part of the boot sole that is in the corresponding position has a corresponding negative profile, which simultaneously achieves a degree of additional guidance between boot sole and ski binding.

As mentioned, in a preferred embodiment of the invention there are also provided a third engagement element, disposed in a middle region of the boot, in particular in the ball or toe-base region of the sole, and a fourth engagement element disposed in a corresponding position on the ski binding. Engagement of these with one another achieves a fixation of the ski boot that inhibits displacement backward on the ski, even if the first and second engagement elements, at the front end of the boot, are so configured that they, would allow such displacement.

In a first preferred embodiment of the first engagement element, it comprises two contact-surface sections, a front one positioned ahead of the second engagement element and an upper one positioned above the second engagement element. These contact-surface sections prevent or limit displacement of the ski boot in the forward and upward directions, respectively. The front contact-surface section in a special design is constructed as a slideway, along which the second engagment element slides downward or upward when the back end of the boot sole is raised or lowered, respectively. In another design the first engagement element is constructed as a hook element with a supplementary, lower contact-surface section that fixes the second engagement element additionally from below. In this latter design the ski binding comprises in its front part a slideway within which the first engagement element as a whole can slide downward and upward.

An especially advantageous embodiment is distinguished by the fact that the first engagement element comprises a catch hook that can be rotated about an axle extending approximately parallel to the upper surface of the ski, and hence to the boot sole, and transverse to the long direction of ski or boot, into which the second engagement element, i.e. the front one on the sole side, can be inserted from behind. This embodiment can in the extreme case be so constructed that the first engagement element is attached to the sole-side second engagement element in such a way that the boot is held to the ski or binding exclusively by these two engagement elements; as a result, the forward rolling motion of the foot described above is made possible, accompanied by corresponding movement of the first and second engagement elements. In this case, of course, measures must be taken to allow the engagement element on the ski or binding side to be released, when necessary, from the second engagement element, on the sole side.

Preferably the first engagement element, constructed as a catch hook, or its axle can be moved forward against the action of an elastic element, in particular a compression spring. Hence the rolling motion of the boot sole on the ski or binding or binding plate can be still more closely matched to the anatomical foot-rolling motion.

In case the first and second engagement elements stabilize the boot only in the forward and upward directions, third and fourth engagement elements must be provided to keep the boot from moving backward and upward; the latter engagement elements preferably act in the region of the ball of the foot or the base of the toes. In a preferred embodiment the fourth engagement element comprises a stopping hook that can rotate about an axle extending approximately parallel to the upper ski surface or boot sole and transverse to the long direction of ski or boot. This stopping hook can be used to pull the third engagement element, on the sole side, forward after it has been displaced backward, so that the boot is kept in position on the binding by the combined action of the two pairs of elements: the first and second engagement elements cooperate to limit the forward movement of the boot, and the third and fourth engagement elements cooperate to limit its backward movement. The engagement elements are of course adapted to one another so that in the region of the front part of the sole, the boot can make the rocking motion described above while resting on the ski, binding or binding case.

Preferably an elastic counterpressure element is provided, which acts in the region in front of the third engagement element so as to apply an upward force to the part of the sole positioned ahead of the third engagement element. This counterpressure element corresponds to the flexor in the first exemplary embodiment described above.

Regarding additional advantages and technical details of the second embodiment, reference is made to claims 20 ff.

BRIEF DESCRIPTION OF THE DRAWINGS

In the following, preferred embodiments of the arrangement in accordance with the invention are explained in greater detail with reference the attached drawings, wherein.

DETAILED DESCRIPTION OF THE PREFERRED EMBODIMENTS

Figure 1:
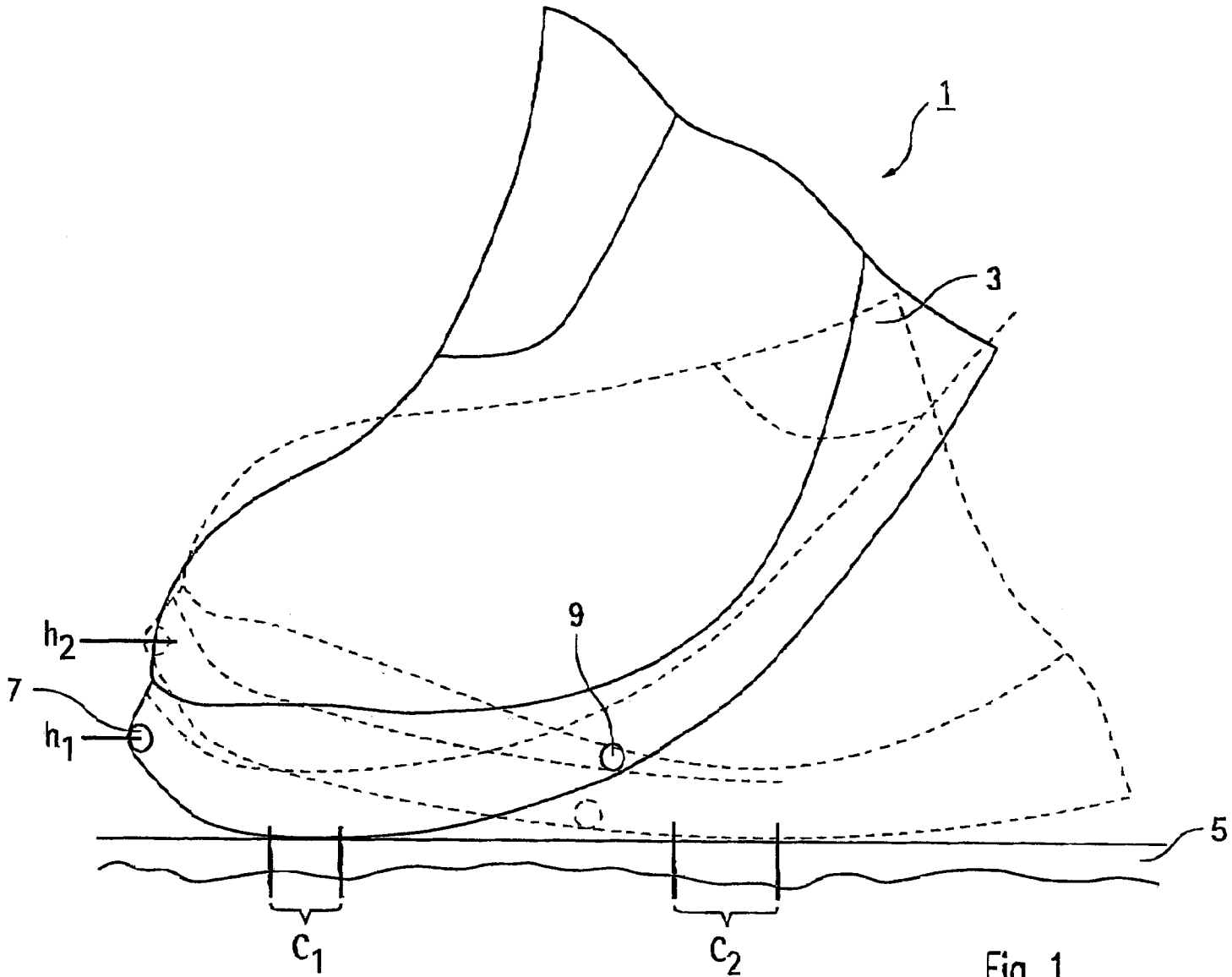
FIG. 1 is a sketch to explain the principles of the invention, showing the front section of a ski boot in two movement positions.

FIG. 1 shows the front section of a ski boot 1 with a boot sole 3 in two of the positions into which it can move on the surface of a ski 5. A first movement position, in which the heel region (not shown) of the boot 1 has been raised far above the surface of the ski 5, is drawn with a continuous line, whereas a second movement position, in which the heel region of the boot is in contact with the ski, is drawn with a dashed line. In the sole 3 of the boot a front and a back engagement element 7 and 9, respectively, are shown; each of these interacts with an engagement element (not shown here) on the binding side so as to fix the boot in position on the ski. It can be seen that the boot sole 3 in the front region, shown here, is smoothly curved in the long direction.

Comparison of the two movement positions makes clear that during the transition from the first, heel-raised position to the second, heel-lowered position, the front end of the sole and hence the front engagement element 7 is raised from a height $h_1$ to a height $h_2$. At the same time, the area of contact between ski boot and ski is shifted backward, from a first contact area $C_1$ to a second contact area $C_2$. It will be evident that the transition from the second to the first movement position is, correspondingly, combined with a lowering of the front end of the sole and a forward shift of the contact area. This movement sequence corresponds quite closely to an anatomically correct rolling motion of the foot along the ball-toe region.

FIGS. 2 to 5 show—schematically in each case—a binding/boot arrangement 100 comprising a ski boot 101 with sole 103 and a ski binding 104.

Here, again, there are disposed in the boot sole 103 a front and a back engagement element 107, 109, each of which has the form of a steel axle oriented transverse to the midplane of the boot and the long axis of the ski. (In the description that follows, and in the claims, these engagement elements on the boot side are also called the second and the third engagement element.)

The ski binding 104 comprises a binding plate 111, a binding-side front (first) engagement element 113, a back (fourth) engagement element 115, an elastomer block 117 that serves as counterpressure element, and fixation/actuation/connection elements associated with the front and back binding-side engagement elements 113, 115. The last of these comprise in particular a sleeve-type slideway 119 for the first engagement element 113, with a helical-spring element 121 that is mounted on the binding plate 111 by way of a first swivelling axle 123, and an actuator lever 129 that is connected both to the slideway 119, by way of an articulated-lever mechanism 125, and to the binding plate 111, by way or a second swivelling axle 127. The fourth engagement element 115, in the form of a hook that encloses the circumference of the third engagement element 109 over ca. 180°, is part of a tensioning band 131 that is constructed or mounted so as to be resilient in its long direction and is attached within the binding plate 111.

Figure 2:
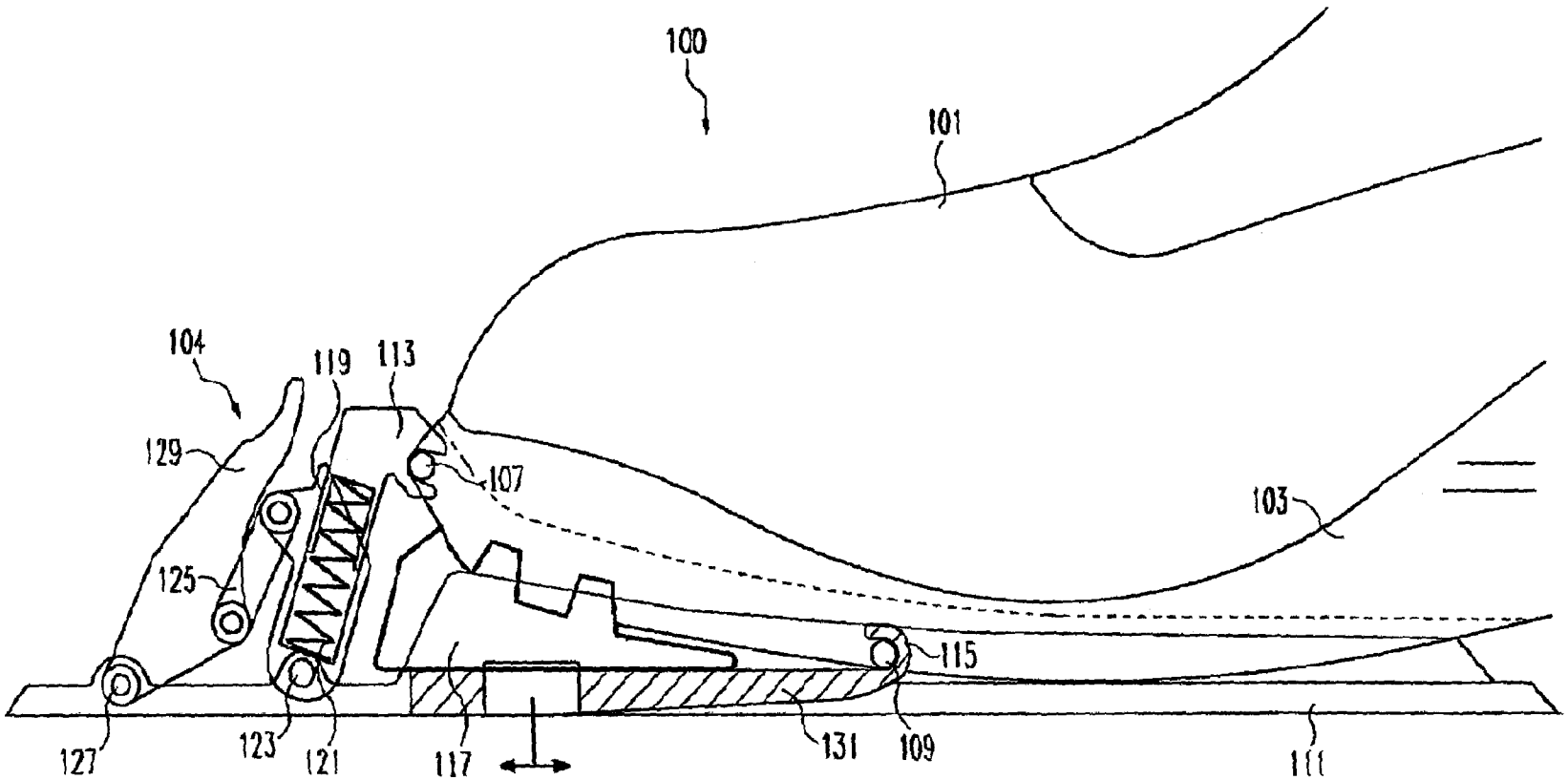
FIGS. 2 to 5 are diagrams (representing partially sectioned side views) of an arrangement according to a first embodiment of the invention in various positions occupied during use.
Figure 3:
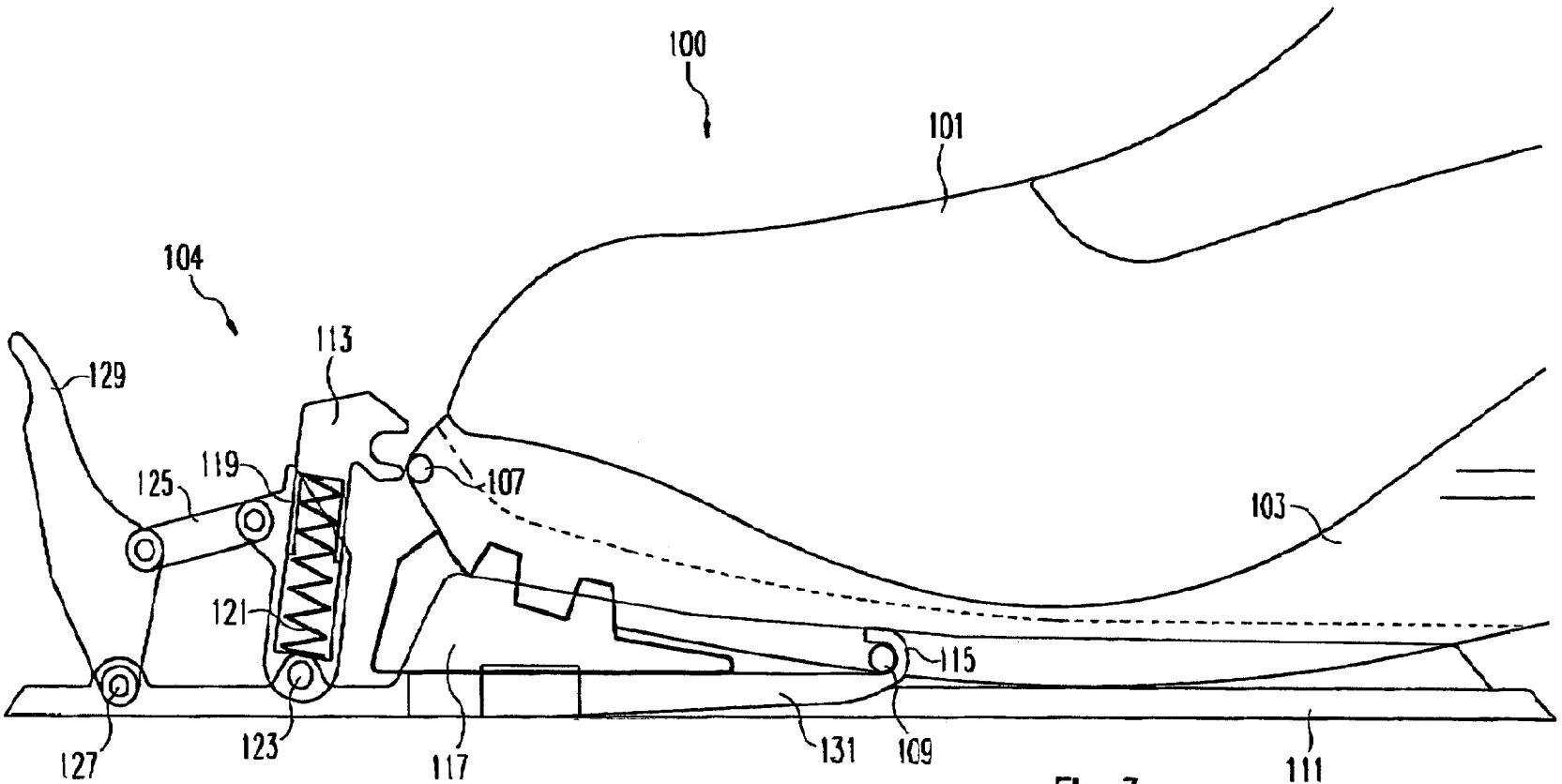
Figure 4:
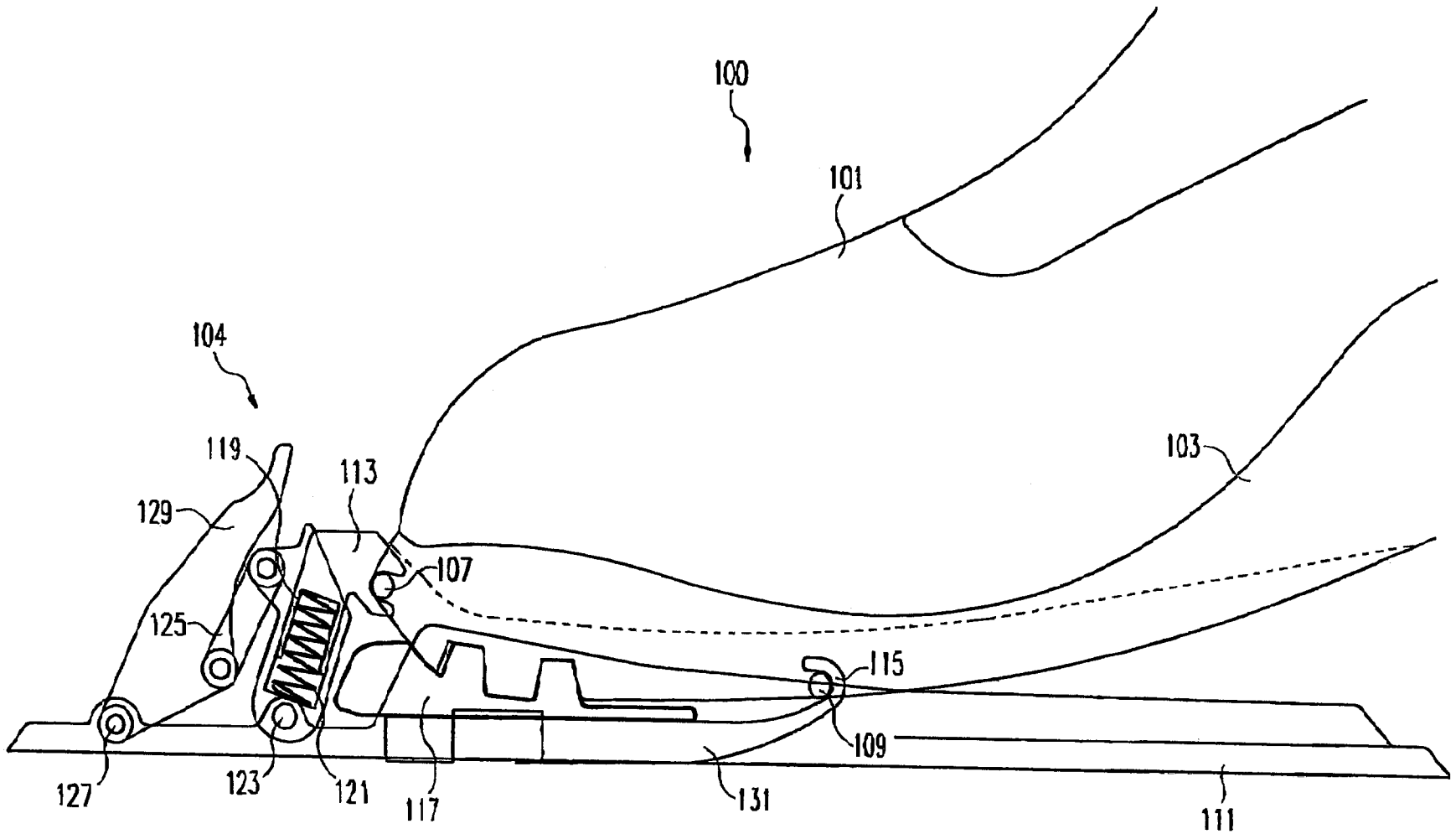
Figure 5:
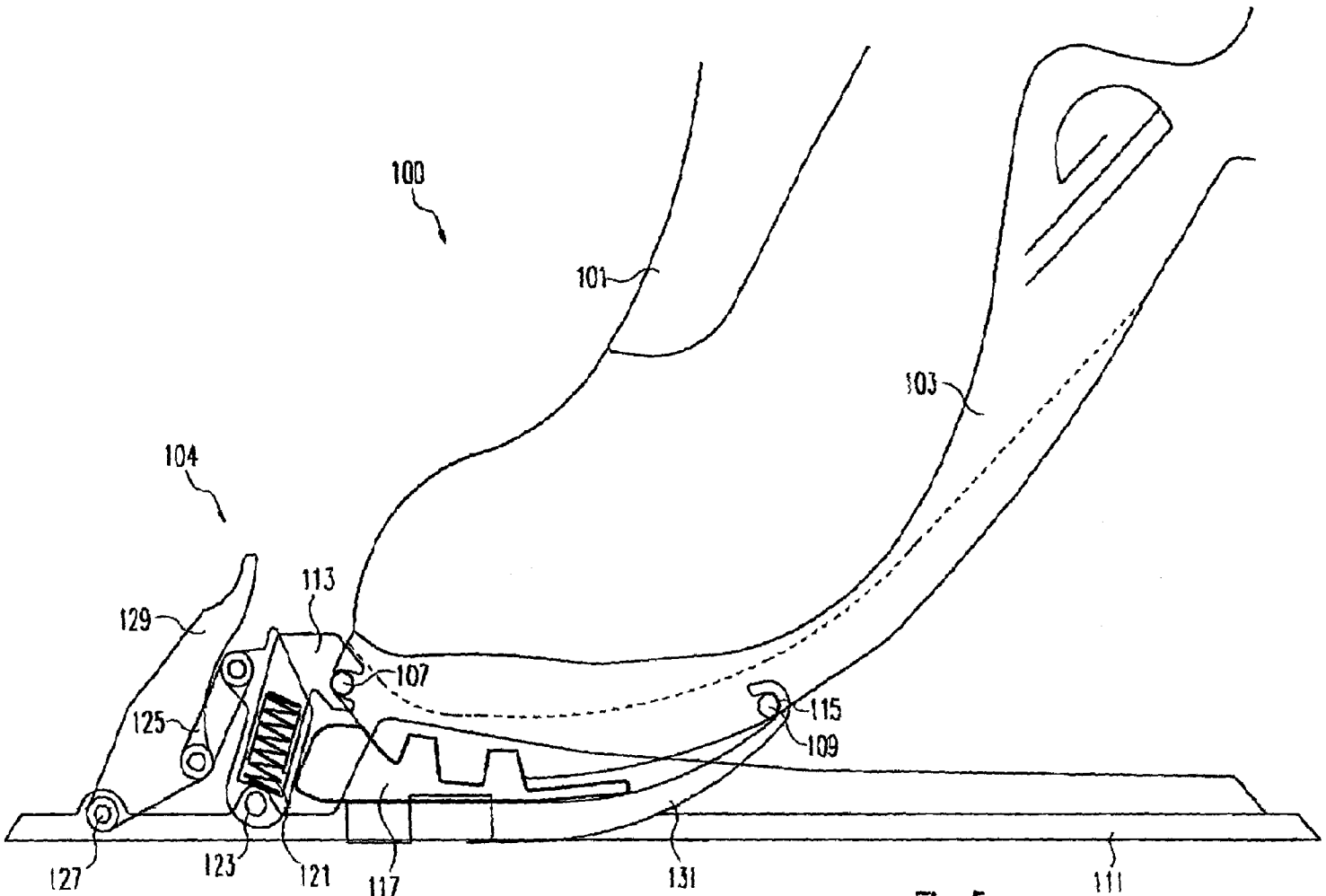

Whereas in FIG. 2 the arrangement 100 is shown in the position for use, in which everything is locked together and the boot is positioned horizontally, in full contact with the ski, FIG. 3 shows the position after the boot has been set onto the ski but before the front locking mechanism has been closed, and FIGS. 4 and 5 show two further movement states in which the boot is raised to different degrees.

It is evident in the figures that the front (first) engagement element 113 on the binding side is constructed as a U-shaped hook, which encloses the front engagement element on the boot side, namely the steel axle 107, by way of an upper, a front and a lower contact-surface section and thus provides fixation with respect to the upward, forward and downward directions. A backward movement of the boot 101 is limited by the interaction of the back engagement elements on the binding side (hook 115) and boot side (axle 109). Furthermore, it can be seen that the above-mentioned vertical movement of the front end of the boot sole 103, and hence of the axle 107 disposed there to serve as second engagement element, is made possible by the sleeve-type slideway 119 and the action of the spring force exerted by the helical-spring element 121, which maintain the engagement of the axle 107 with the hook 113, which serves as first engagement element. A permanent engagement between the back axle 109 and the associated hook 115 is achieved by making the tensioning band 131 longitudinally elastic, or by making it flexible and mounting it so that it can be displaced longitudinally in a resilient manner; as a result of this flexibility and elasticity, when the back axle 109 on the boot sole 103 moves vertically as the heel of the boot is raised, this movement is followed without breaking the engagement. Finally, the drawings also illustrate the elastic deformation of the elastomer block 117 while the heel is being raised and the front end of the sole correspondingly moved in the opposite direction, which causes an elastic restoring force to be imposed against this movement.

Figure 6:
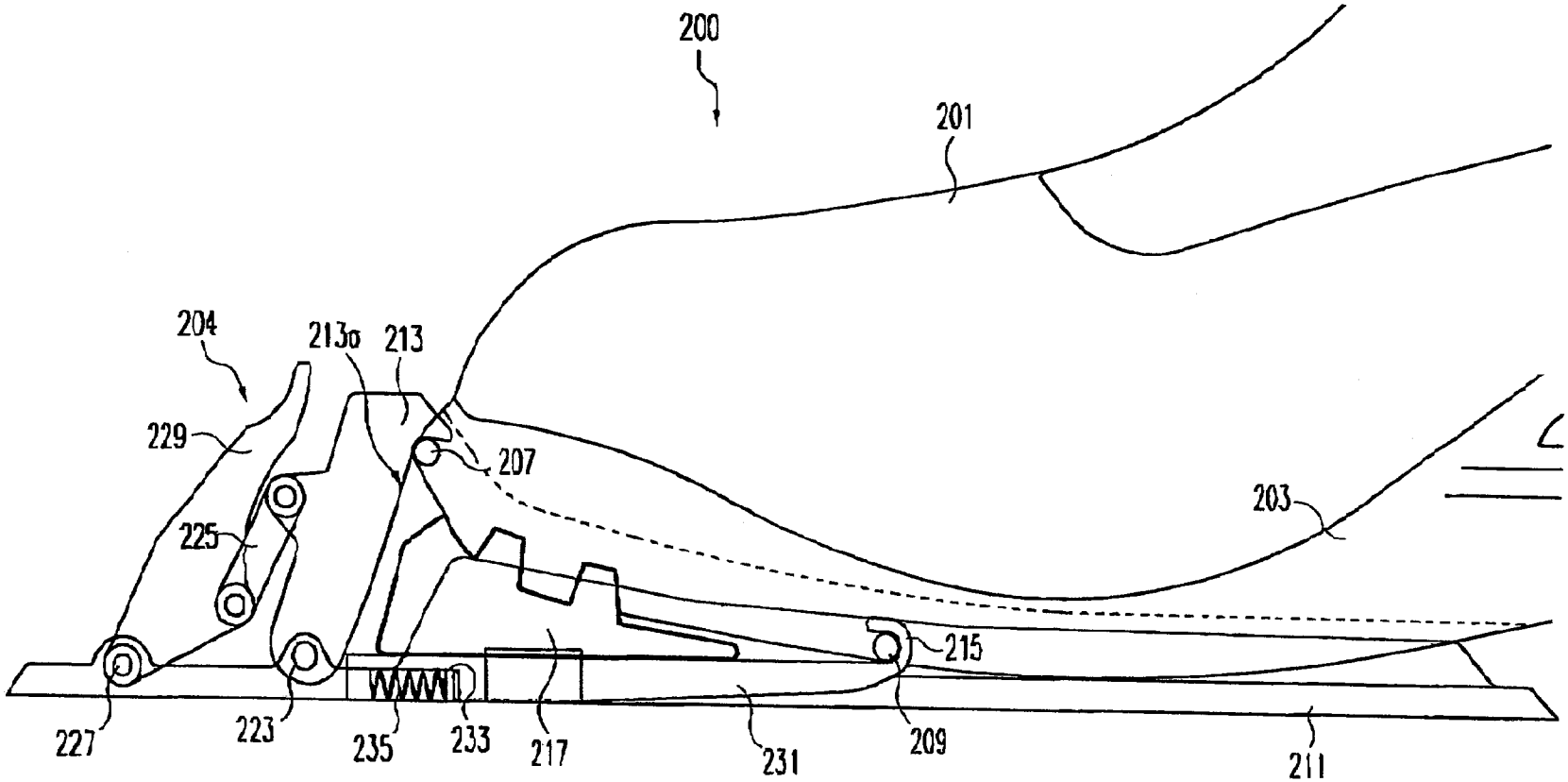
FIGS. 6 to 8 are diagrams (representing partially sectioned side views) of an arrangement according to a second embodiment of the invention in various positions occupied during use.
Figure 7:
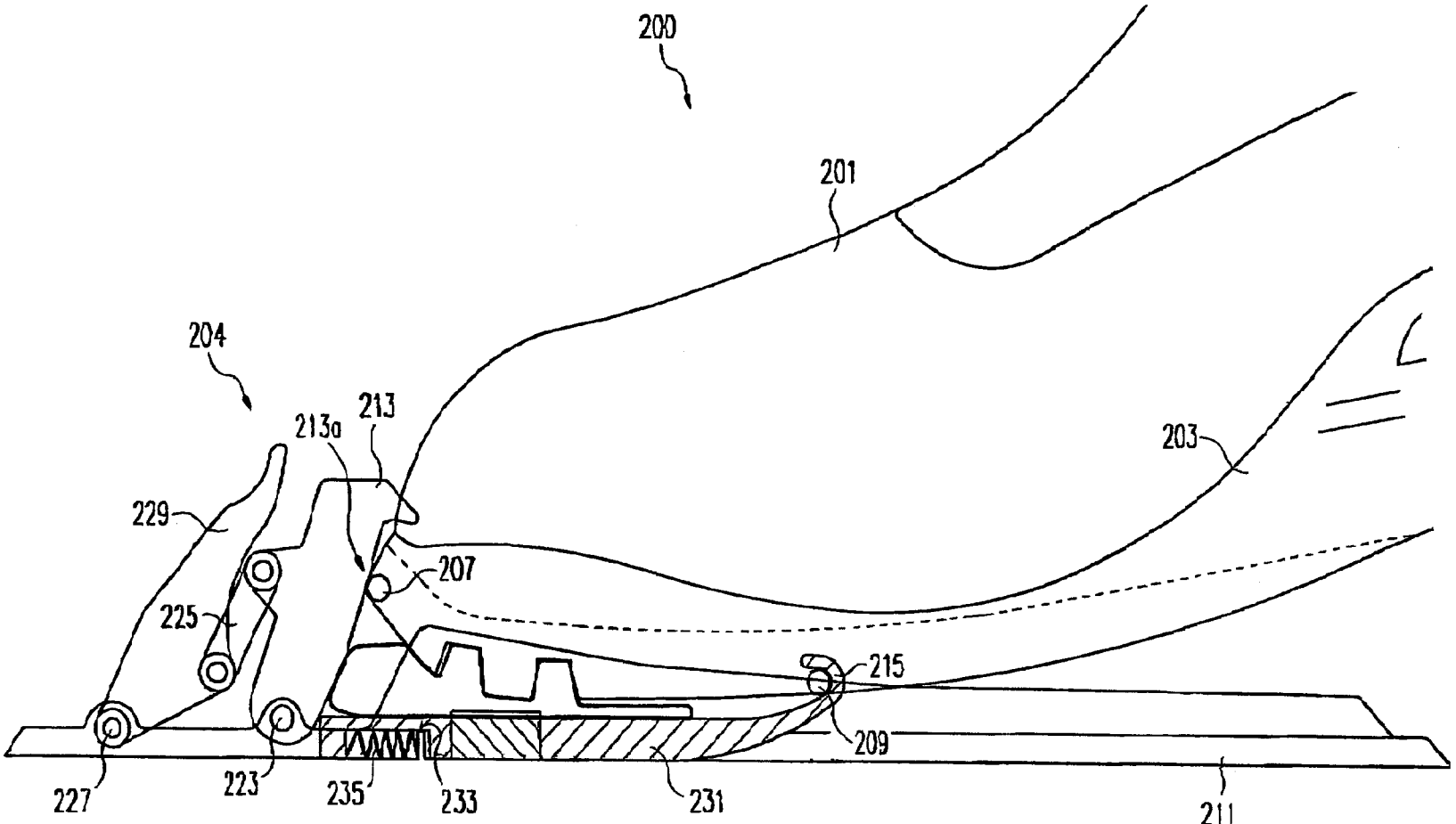
Figure 8:
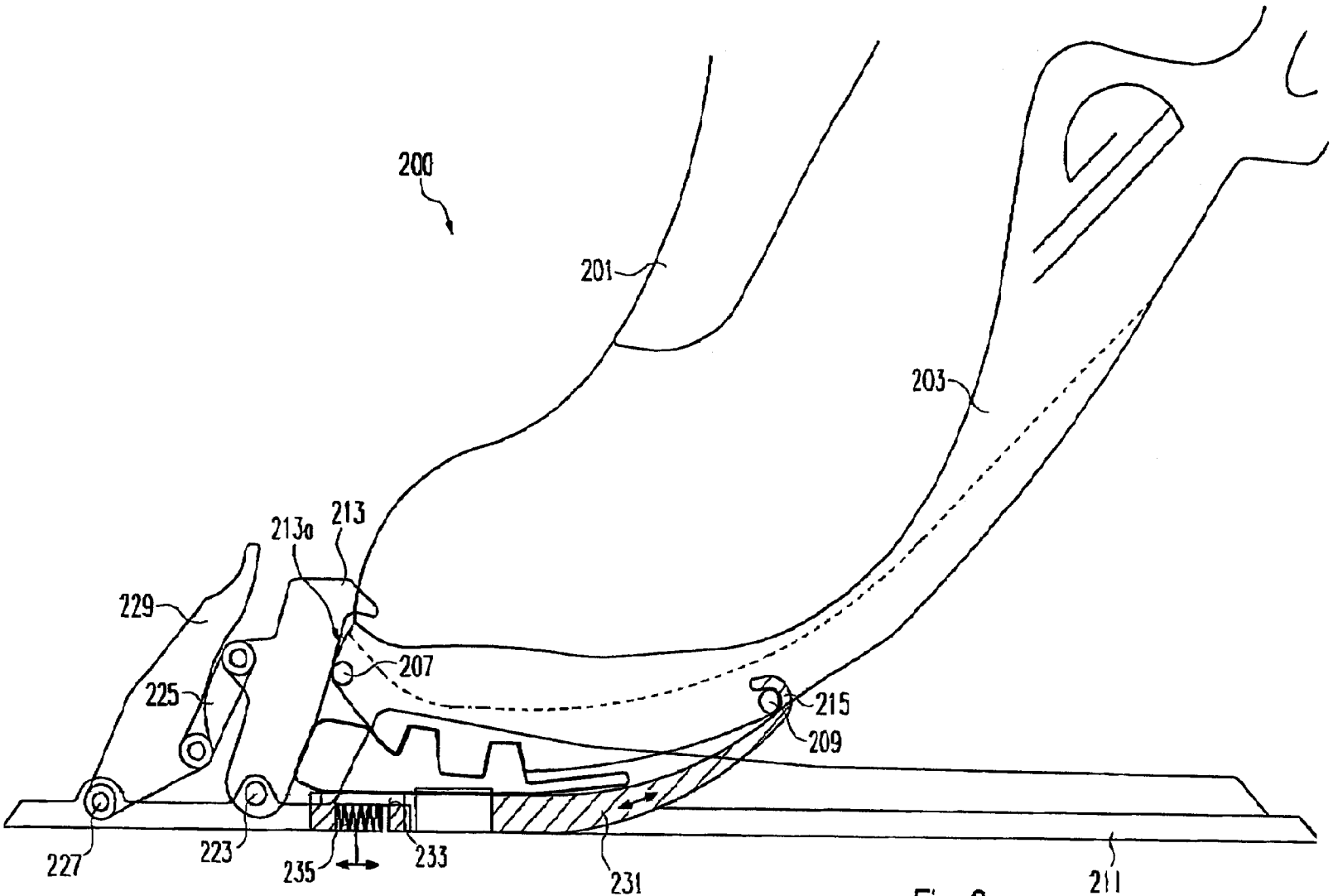

In FIGS. 6 to 8 is shown a binding/boot arrangement 200 that is modified in comparison to the first embodiment. Because most of the components are identical or at least for the most part function correspondingly, the reference numerals here correspond to those shown for the first embodiment, and in the following only the differences from the first embodiment are described. The two embodiments are exactly the same with respect to the construction of the ski boot 201 and the elastomer block 217.

A first modification consists in the altered construction of the front binding-side engagement element (hook) 213 and the associated connection to the binding plate 211. The hook 213 is connected to the binding plate 211 directly by way of a swivelling axle 223, i.e. with no slideway or spring element. Here the force pressing it against the front axle 207 on the boot sole 203 is exerted by way of the actuator lever 229 and the articulated-lever mechanism 225 and originates from the torsion spring (not shown separately) associated with the swivelling axle 227 of the actuator element 229. The back edge or surface 213*a* of the hook, which faces the axle 207, forms a slideway for the axle 207, along which the axle slides when the heel of the ski boot 201 is moved downward or upward (cf. FIG. 6 with FIG. 7 and FIG. 8).

The second substantial difference from the arrangement 100 according to FIGS. 2 to 5 resides in the provision of a sleeve-type slideway 233 with internal helical-spring element 235 in the region where the tensioning band 231 is fixed to the binding plate 211. Because this measure creates the longitudinal elasticity needed for the connection between binding plate and back hook 215, in this embodiment the tensioning band 231 is not itself made longitudinally elastic, although it is flexible.

Figure 9:
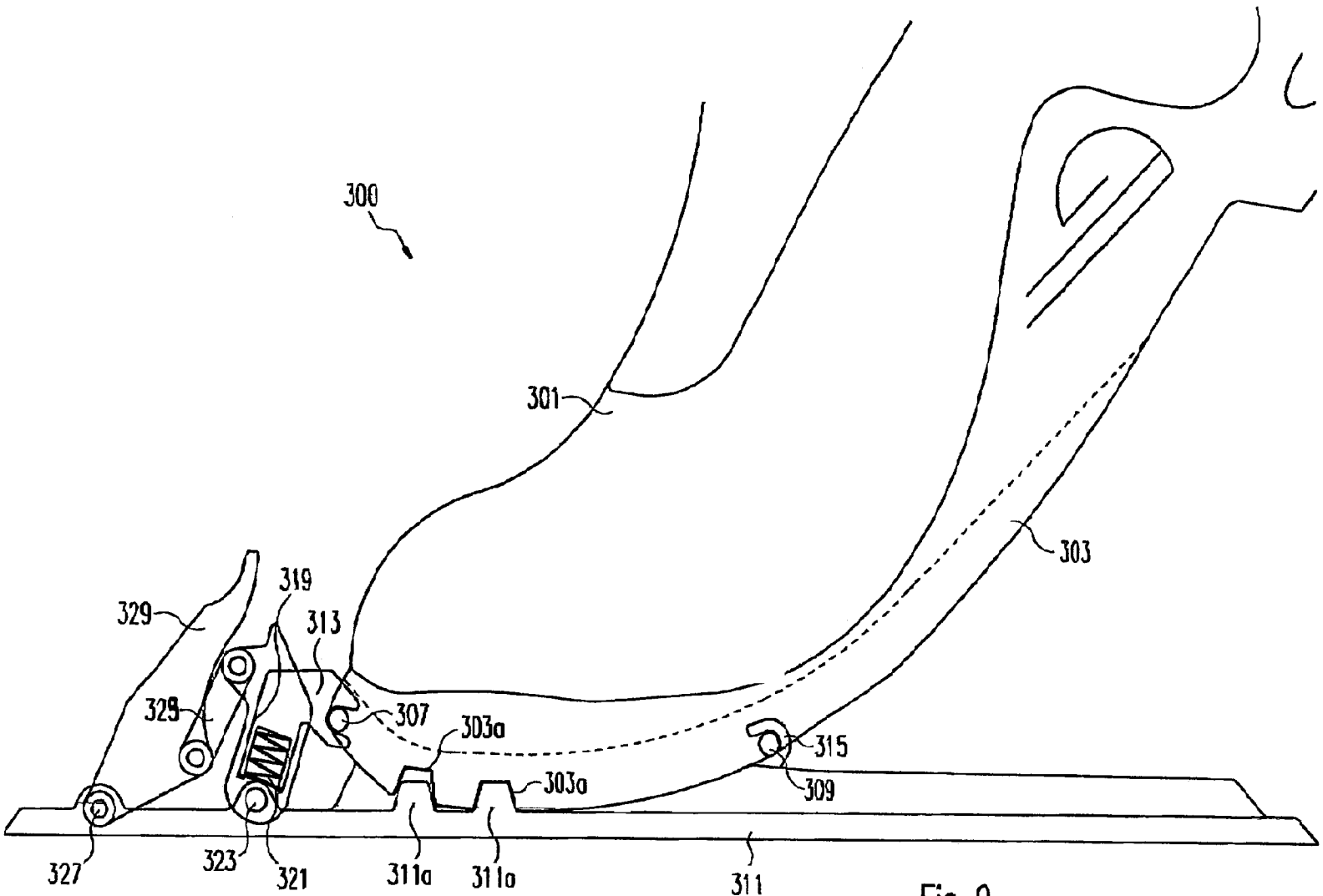
FIGS. 9 to 11 are diagrams (representing side views or partially sectioned side views) of an arrangement according to a third embodiment of the invention, with the boot in two positions.
Figure 10:
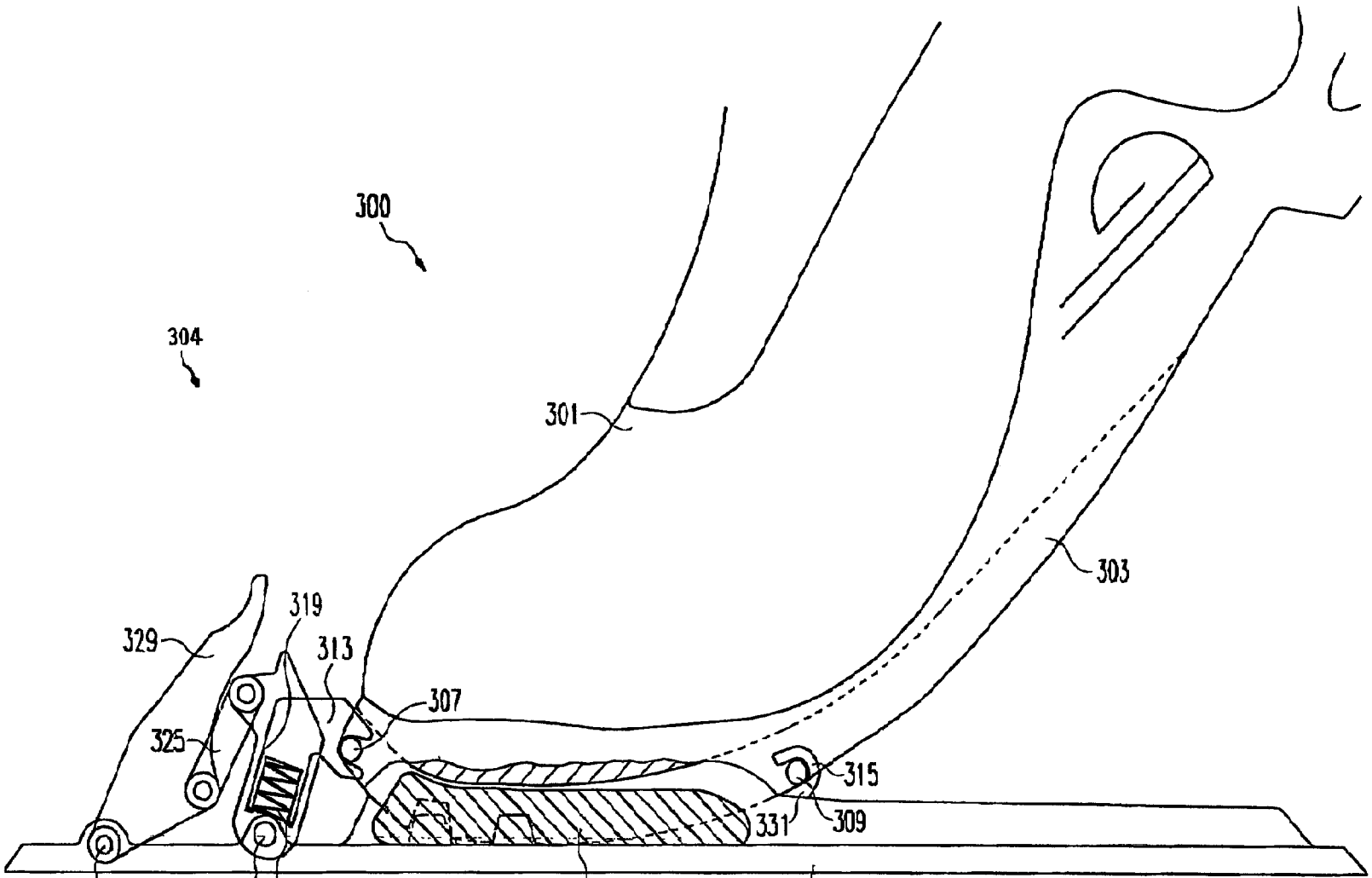
Figure 11:
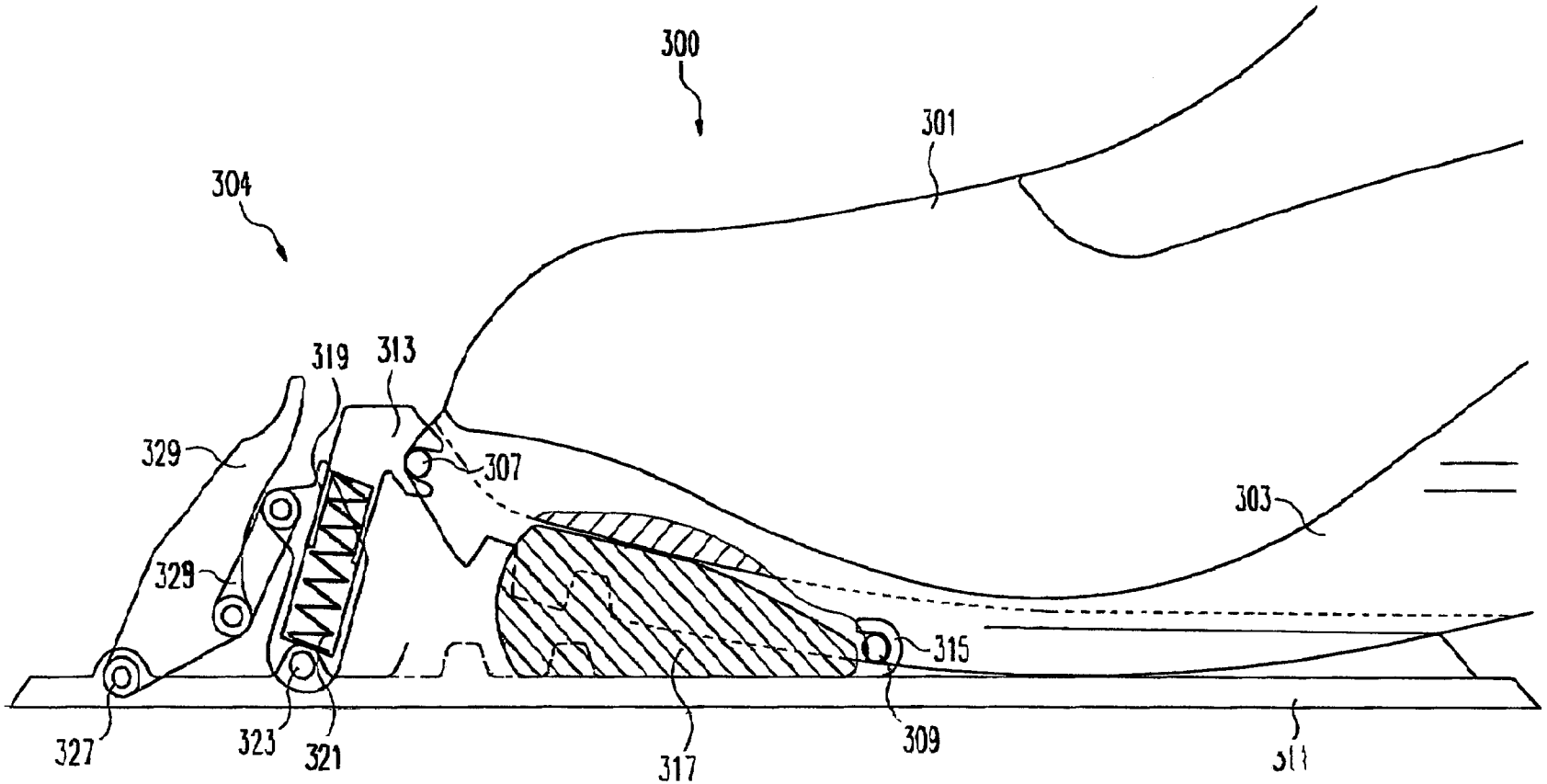

FIGS. 9 to 11 show, as a third embodiment, a binding/boot arrangement 300 which in turn is largely the same as the arrangement 100 according to FIGS. 2 to 5, so that again in the drawings corresponding reference numerals have been chosen and in the following description the explanation of corresponding parts is not repeated. Here the construction of the ski boot 301 and of the binding-side engagement elements, including the associated fixation, connection and actuation means, are all just the same as in the first embodiment.

The substantial difference consists in the construction of the binding plate 311 in the region of the counterpressure element 317, and also in the construction of the latter. The binding plate 311 has a binding-plate profile structure 311*a*, which is designed to engage with recesses 303*a*, which have a corresponding negative profile, in the boot sole 303 (for instance, in its edge region). In contrast, the counterpressure element 317, which here again has the form of an elastomer block, is unprofiled and fits into an elongated recess in the middle region of the front end of the boot sole 303. (This recess is in principle also present in the other embodiments and is not specially identified in FIGS. 9 to 11.) Comparison of FIGS. 10 and 11 makes clear how the elastomer block 317, in contact with the curved underside of the boot sole 303 (in the recess), becomes deformed as the heel is raised and lowered. With respect to function, the result is substantially the same effect as is obtained with the profiled embodiment of the counterpressure element shown in FIGS. 2 to 5.

In FIGS. 12 to 16 is shown a binding/boot arrangement 400 still further modified in comparison to the embodiments previously described. Because most of the components are identical or at least for the most part function correspondingly, the reference numerals here correspond to those shown for the preceding embodiments, and only the differences from the first embodiment are described here. The functionally corresponding parts are all identified by reference numerals, the first digit of which is a 4 instead of 1, 2 or 3.

Accordingly, the arrangement 400 shown in FIGS. 12 to 16 is distinguished by the fact that the first engagement element 413 comprises a catch hook 433 that can be swivelled about an axle 432 that extends approximately parallel to the upper surface of the ski and to the boot sole 403, and transverse to the long direction of ski and boot. The front engagement element on the sole side, namely the second engagement element 407, can be inserted into the hook from the back. The catch hook 433 thus limits the forward movement of the ski boot 401. The second engagement element is constructed as a transverse axle made of stainless steel or the like and integrated into the sole; in this specific case, it is lamellar in shape.

Figure 13:
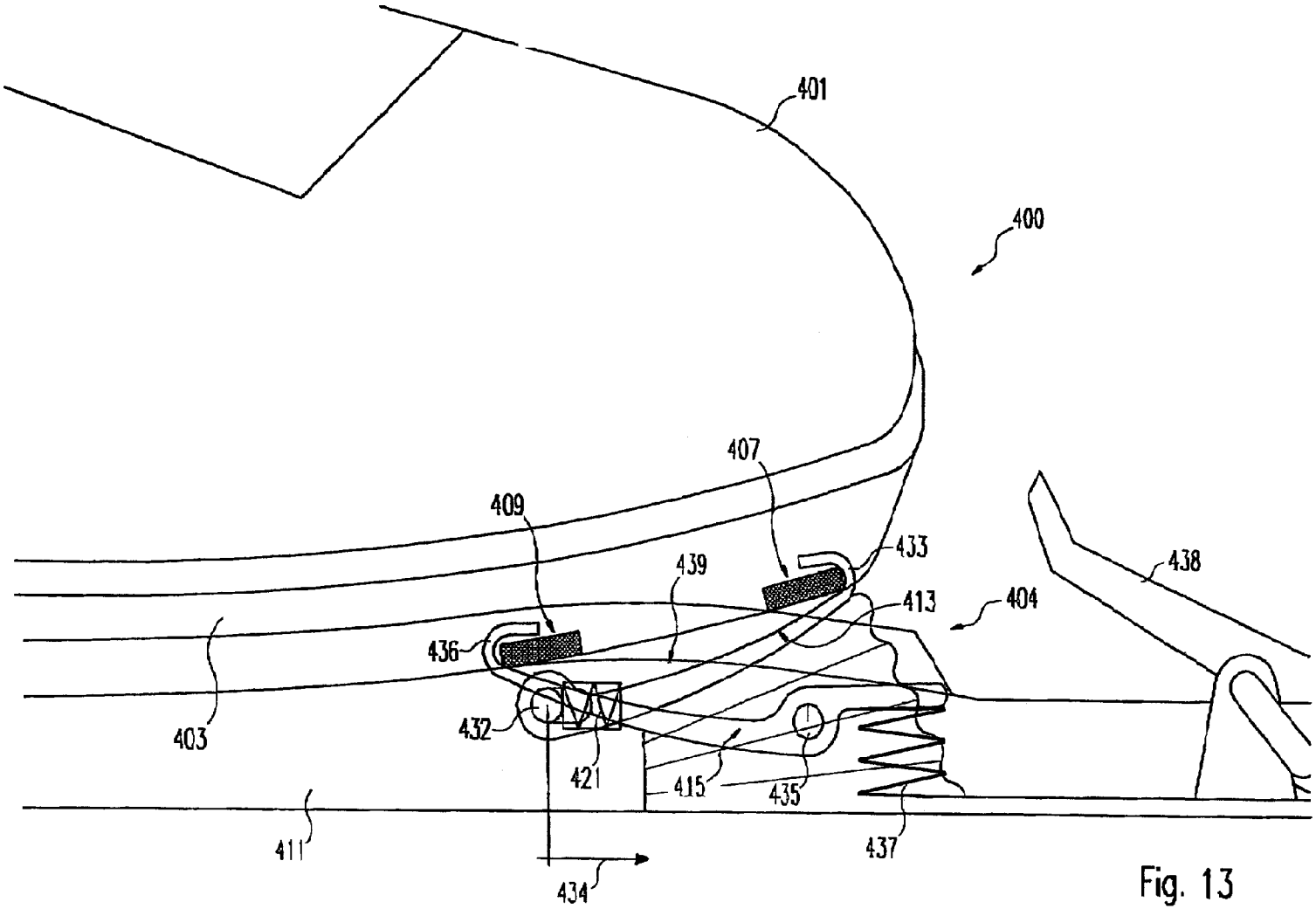
Figure 14:
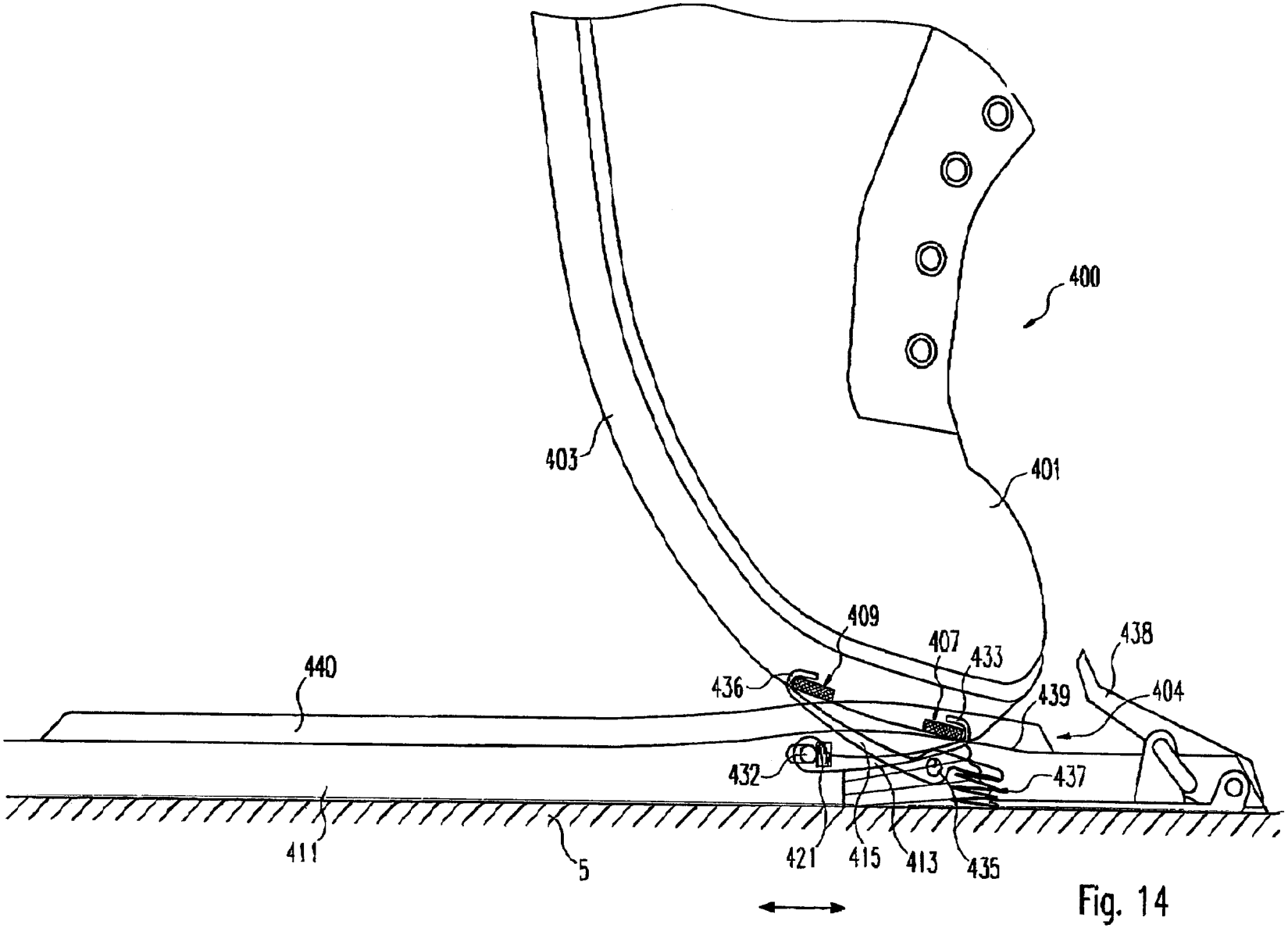
Figure 15:
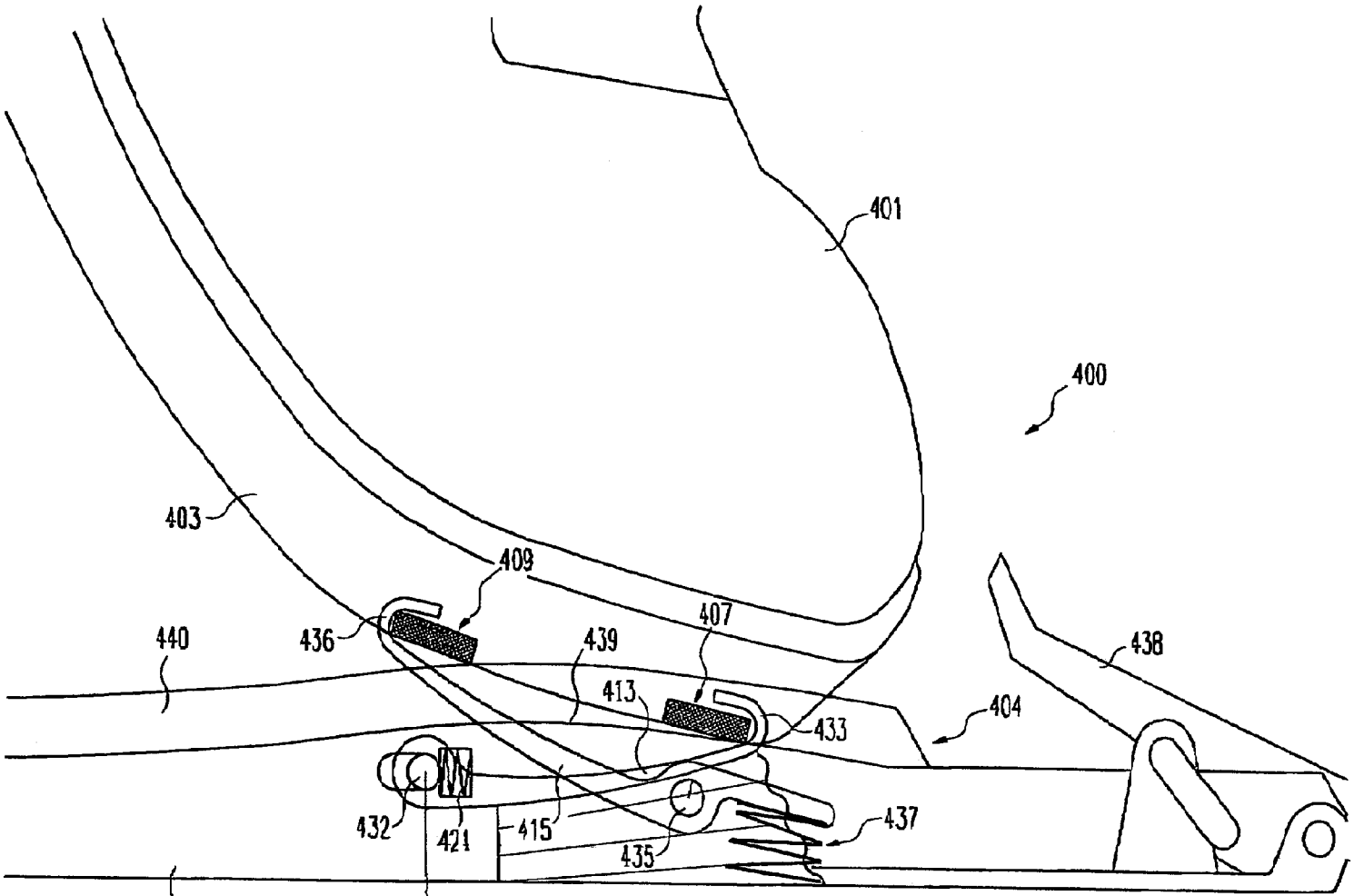

The catch hook 433 along with its swivelling axle 432, as is especially clearly visible in FIG. 13, can be moved forward (in the direction of the arrow 434) against the action of an elastic element, in this case a compression-spring element 421. Thus the catch hook 433 is free to move along with the second engagement element 407 when the front part of the sole is rolled along the ski or a binding plate 411. For this purpose, the axle 432 is mounted within a slot-like recess 440 in the binding case or binding plate 411 so that it can be shifted longitudinally, against the action or the compression-spring element 421.

Because the ski boot is free to make a rolling motion along the binding plate 411, the second engagement element 407 must necessarily move both in the long direction of the ski and also perpendicular to the upper surface of the ski. These movement components should not be impaired by the catch hook 433.

The fourth engagement element 415 likewise comprises a stopping hook 436 that can swivel about an axle 435 oriented approximately parallel to the upper surface of the ski, and hence to the boot sole 403, and transverse to the long direction of ski and boot. The forward pull exerted by this hook counteracts backward displacement of the third engagement element 409, so that the boot 401 is kept in position on the binding 404 by the cooperative action of the various engagement elements, namely the first and second engagement elements, which limit the forward movement of the boot 401, and also the third and fourth engagement elements, which limit movement of the boot 401 in the backward direction.

Figure 16:
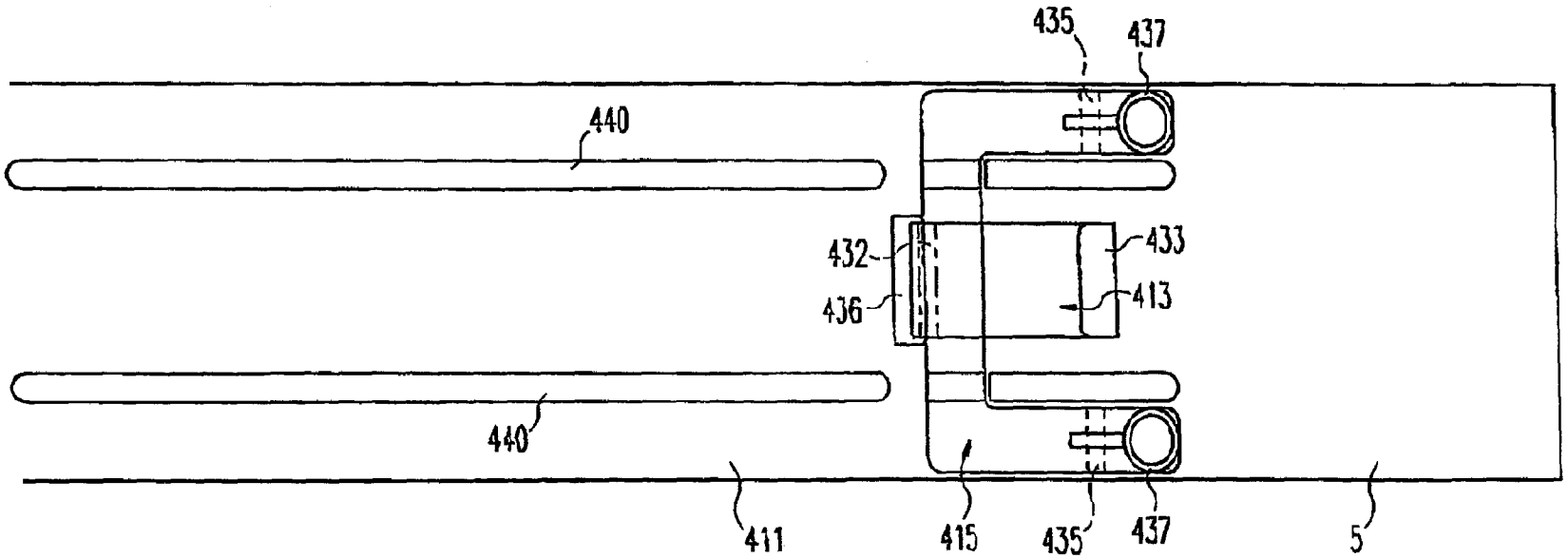

In the region ahead or the third engagement element 409 an elastic counterpressure element 437 acts to apply an upward force to the part of the sole situated in front of the third engagement element 409. In this specific case the elastic counterpressure element 437 is associated with the fourth engagement element 415 and is constructed as a compression spring. Instead of a compression spring, an elastomer block can also be provided. As shown in FIG. 16, the fourth engagement element is a U-shaped part, the two limbs of which are so disposed that they can rotate about the axle 435. The two limbs extend forward beyond said axle 435, so that each component of the counterpressure element 437 acts between the limb extensions on one hand and the upper surface of the ski or the binding case on the other. The stopping hook 436 is disposed on the cross-piece of the U-shaped fourth engagement element, in a central position opposite the catch hook 433 associated with the second engagement element (see FIG. 16).

The fourth engagement element 415, and hence the stopping hook 436 associated therewith, can be displaced in the long direction of the ski, from a boot-release position into a boot-retaining position, as shown in FIGS. 12 to 15, and back again. This longitudinal displacement of the fourth engagement element 415 is brought about by an actuation mechanism associated with the fourth engagement element that comprises an actuator lever 438, which occupies a stable top-dead-center position when the fourth engagement element is in the boot-retaining position. Because this is a mechanism Known per se, no more detailed drawing or description is needed here.

The longitudinal guidance of the boot 401 on the ski 5 or the binding plate 411 is brought about by longitudinal ribs 440 that correspond to one another and longitudinal grooves on the tread aide of the boot sole 403 and/or the sole-supporting surface 439 of the ski or the binding plate 411.

In the embodiment shown here, the third engagement element 409 is positioned in the front ball region or back toe-base region, whereas the second engagement element 407 is situated at the front end of the sole, but on its underside. Theoretically the second engagement element could also be positioned ahead of the front end of the sole.

Figure 12:
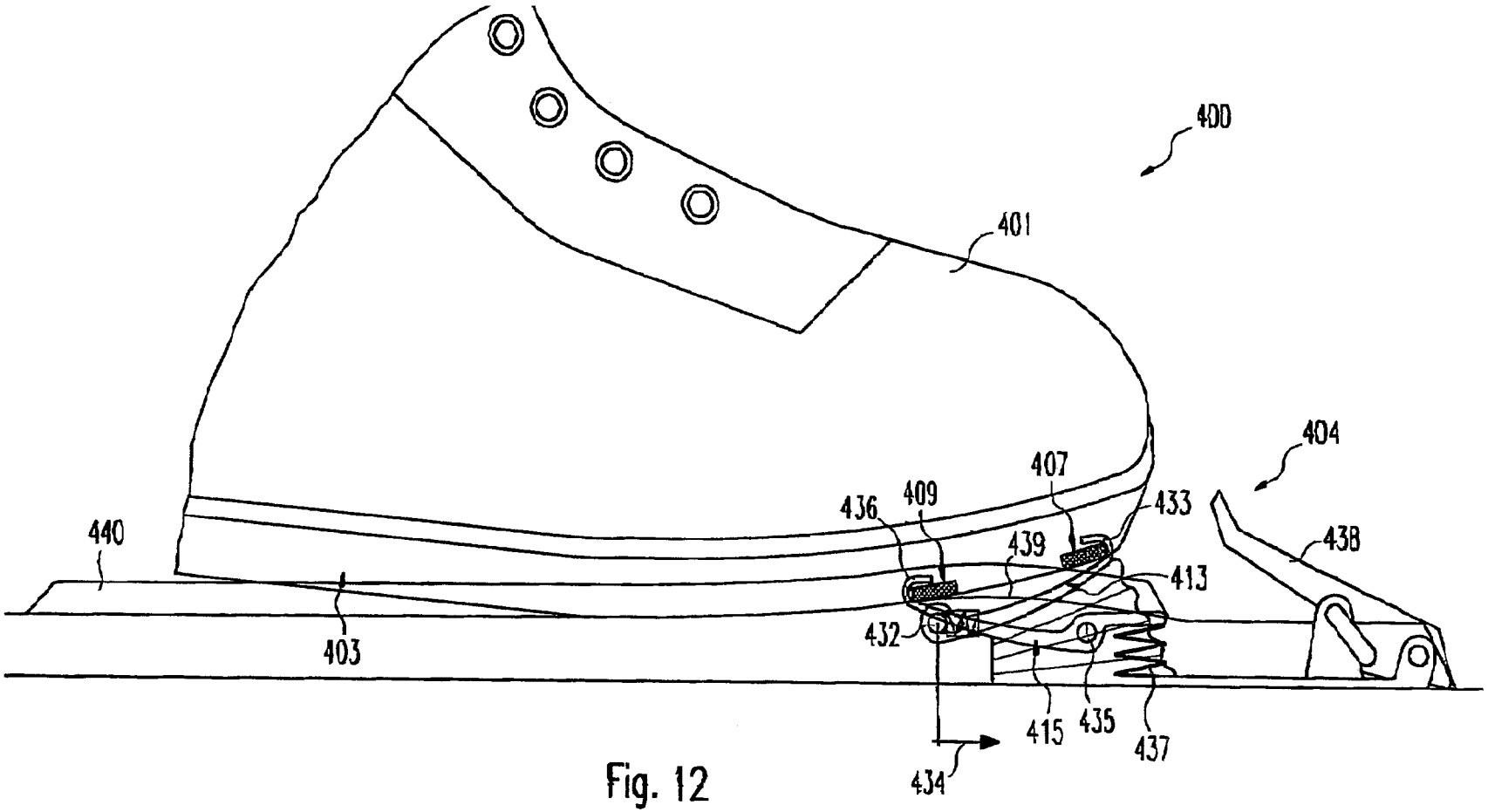
FIGS. 12 to 16 are diagrams (representing side views at various scales as well as a plan view) of an arrangement according to a fourth embodiment of the invention in two positions of the boot, wherein the plan view shows only the binding-side part of the arrangement.

The catch and stopping hooks 433 and 436, respectively, thus move freely along with the rolling motion of the boot sole when the heel is raised, while simultaneously fixing the boot 401 in position with respect to both the forward and backward directions and, of course, also the upward direction. Thus the ski boot can make a rolling motion on the binding plate 411 with substantially no restraint, as can clearly be seen by comparing FIGS. 12 and 13 with FIGS. 14 and 15. The drawings in FIGS. 12 and 13 show the boot heel lowered so as to rest on the ski. In the drawings according to FIGS. 14 and 15, the boot heel is maximally raised.

In the embodiment shown here the longitudinal guide ribs are formed on the upper surface or sole-supporting surface 439 of the binding plate 411. On the lower surface or tread side of the boot sole 403, corresponding longitudinal grooves are provided.

Furthermore, the sole-supporting surface 439 has a convex curvature in the long direction of the ski or boot where it is associated with the front part of the boot sole. This configuration is useful when the front sole region has a substantially flat shape. In the embodiments previously described such a convexly curved sole-supporting surface 439 is not required, because in these embodiments the front region of the boot sole is itself convexly curved in the long direction of ski or boot. Both embodiments permit the boot to make a rolling motion on the substrate, accompanied by longitudinal shifting of the contact line between boot and ski or binding plate, when the heel of the boot is raised or lowered.

In principle it is also conceivable to fix the boot to the ski or binding only by means of the third and fourth engagement elements, in which case of course care must be taken to ensure that the fourth engagement element encloses the third engagement element completely, so that the boot is fixed in position with respect to both forward and backward movement. The mechanical measures that would be required for this purpose can be avoided by a solution such as is described with reference to FIGS. 1 to 16.

The implementation of the invention is not restricted to the examples described above but is also possible in a large number of modifications that are within the competency of those skilled in the art.

List of reference numerals

| | |
|---|---|
| 1; 101; 201; 301; 401 | Ski boot |
| 3; 103; 203; 303; 403 | Boot sole |
| 5 | Ski |
| 7; 107; 207; 307; 407 | Front (second) engagement element (axle) |
| 9; 109; 209; 309; 409 | Back (third) engagement element (axle) |
| 100; 200; 300; 400 | Ski binding/boot arrangement |
| 104; 204: 304; 404 | Ski binding |
| 111; 211; 311; 411 | Binding plate |
| 113; 213; 313; 413 | Front (first) engagement element (hook) |
| 115; 215; 315; 415 | Back (fourth) engagement element (hook) |
| 117; 217; 317 | Counterpressure element (elastomer block) |
| 119; 219; 319 | Sleeve-type slideway |
| 121; 235; 321 | Helical-spring element |
| 123; 127; 233; 227 | Swivelling axle |
| 125; 225; 325 | Articulated-lever mechanism |
| 129; 229; 329 | Actuator lever |
| 131; 231; 331 | Tensioning band |
| 213a | Back edge or surface |
| 303a | Recesses |
| 311a | Binding-plate profile |
| C1, C2 | Contact area between boot and ski |
| h1, h2 | Height of the front sole end above the ski |
| 432 | Swivelling axle |
| 433 | Catch hook |
| 434 | Arrow |
| 435 | Swivelling axle |
| 436 | Stopping hook |
| 437 | Counterpressure element |
| 438 | Actuator lever |
| 439 | Sole-supporting surface |
| 440 | Guide rib |

What is claimed is:

1. An arrangement comprising a ski binding and a ski boot adapted thereto with a boot sole, such that the arrangement includes:

a first engagement element on the binding side, a second engagement element on the boot side in a front region thereof, wherein in a position for use the first and second elements are engaged with one another and keep the ski boot in substantial linear or areal contact with a ski or a binding plate attached to a ski, wherein at least one of an underside of the boot sole in a front region, and a sole-supporting surface on the ski or binding plate that is associated with the front sole region, is convexly curved in a long direction of the ski and boot, and wherein the first and second engagement elements are adapted to one another in such a way that when a back end of the boot is raised or lowered, with an accompanying, corresponding movement of the first and second engagement elements, the boot sole makes a rolling motion associated with a longitudinal shift of a contact line or area on the ski or binding plate and with a movement of the front end of the boot in the direction opposite to that of the movement of the back end;

a third, boot-side engagement element in a middle region of the front part of the sole adjacent a region between the ball of the foot and base of the toes, and in a corresponding position on the ski binding a fourth, binding-side engagement element that engages the third engagement element so that the third and fourth engagement elements limit the extent to which the ski boot can be displaced backward with respect to the ski or binding plate and wherein at least one of the second and third engagement elements on the boot sole is constructed as an axle that extends generally transverse to the long axis of the ski, wherein the fourth engagement element comprises a stopping hook that can be swivelled about an axle extending approximately parallel to the upper ski surface or boot sole and transverse to the long direction of ski or boot, by means of which the third, sole-side engagement element, if it has been displaced backward, can be pulled in the forward direction, so that the boot is kept in position on the binding by the combined action of the first and second engagement elements which cooperate to limit movement of the boot in the forward direction, as well as the third and fourth engagement elements, which cooperate to limit movement of the boot in the backward direction.

2. The arrangement of claim 1 wherein at least one of the first and second engagement elements comprise a first spring element which applies tension to the front end of the boot sole that tends to force the latter toward the ski or binding plate.

3. The arrangement of claim 1, wherein the first engagement element comprises at least one front contact-surface section, situated in front of the second engagement element, and one upper contact-surface section, situated above the second engagement element wherein the front contact-surface section limits displacement of the boot with respect to the ski in the forward direction, and the upper contact-surface section limits upward displacement thereof.

4. The arrangement according to claim 3, characterized in that the front contact-surface section is constructed as a slideway along which the second engagement element slides downward or upward when the back end of the boot sole is raised or lowered, respectively.

5. The arrangement according to claim 3, characterized in that the first engagement element is constructed as a hook element that comprises a lower contact-surface section disposed below the second engagement element that as a whole can slide substantially vertically.

6. The arrangement according to claim 5, characterized in that the ski binding comprises a slidaway for the first engagement element in the region of which the first spring member is disposed.

7. The arrangement of claim 1, wherein at least one of the third and fourth engagement elements comprises a second spring member which applies tension that tends to force the sole of the boot toward the ski or the binding plate.

8. The arrangement according to claim 7 characterized in that the second spring member is constructed as a longitudinally elastic band or cable, which extends below or along the side of the boot sole and connects the fourth engagement element to a fixation point on the ski or binding plate.

9. The arrangement according to claim 7, characterized in that the second spring member is constructed as a horizontally acting spring element that is disposed in the ski binding and is connected to the fourth engagement element by a band or cable that is substantially inelastic in the longitudinal direction.

10. The arrangement of claim 1, further comprising an elastically compressible counterpressure element positioned behind the first engagement element on the ski or the binding plate or behind the second engagement element on the underside of the boot sole such that the elastically compressible counterpressure element applies upwardly directed force to the corresponding part of the boot sole.

11. The arrangement of claim 10 wherein at least one of the third and fourth engagement elements comprises a second spring member which applies tension that tends to force the sole of the boot towards the ski or the binding plate and wherein the counterpressure element is disposed substantially between the first and fourth engagement elements on the ski or the binding plate or between the second and third engagement elements on the sole of the boot.

12. The arrangement of claim 10 wherein the counterpressure element comprises an elastomer block.

13. The arrangement according to claim 12, wherein at least one of the elastomer block and the binding plate have ridged or cleated profiles that correspond to one another.

14. The arrangement of claim 13, wherein correspondingly positioned sections of the binding plate and boot sole have correspondingly ridged profiles.

15. The arrangement of claim 1, wherein at least one of the second and third engagement elements on the boot sole is each constructed as an axle that extends transverse to the long axis of the ski.

16. The arrangement of claim 15 wherein the axle comprises steel.

17. The arrangement of claim 1, characterized in that the first engagement element comprises a catch hook that can be swivelled about an axle extending approximately parallel to the upper surface of the ski or the boot sole and transverse to the long direction of ski or boot, into which the front, second engagement element on the sole side can be inserted from behind.

18. The arrangement according to claim 17, characterized in that the catch hook or its swivelling axle is movable in the forward direction against the action of an elastic element.

19. The arrangement of claim 18 wherein the elastic element comprises a compression spring element.

20. The arrangement of claim 17, wherein longitudinal guidance of the boot on the ski or the binding plate is brought about by longitudinal ribs and grooves on at least one of the tread side of the boot sole and the sole supporting area of the ski or binding plate.

21. The arrangement according to claim 1, characterized in that, in the region in front of the third engagement element, an elastic counterpressure element is provided so as to apply upward-directed force to the section of the sole situated ahead of the third engagement element.

22. The arrangement according to claim 21, characterized in that the elastic counterpressure element is an elastomer block or compression spring associated with the fourth engagement element.

23. The arrangement of claim 1, wherein the fourth engagement element can be shifted in the long direction of the ski, out of a boot-release position into a boot-retaining position and conversely.

24. The arrangement according to claim 23, characterized in that the fourth engagement element is connected to an actuator lever that occupies a stable top-dead-center position when the second engagement element is in the boot-retaining position.

25. The arrangement of claim 1, wherein the third engagement element is positioned in the ball and toe-base region whereas the second engagement element is situated at the front end of the sole.

26. The arrangement of claim 1 wherein the fourth engagement element can be shifted in the longitudinal direction of the ski out of a boot release position into a boot retaining position and conversely.

* * * * *

UNITED STATES PATENT AND TRADEMARK OFFICE

CERTIFICATE OF CORRECTION

PATENT NO. : 6,986,526 B2
APPLICATION NO. : 10/297879
DATED : January 17, 2006
INVENTOR(S) : Hauglin It is certified that error appears in the above-identified patent and that said Letters Patent is hereby corrected as shown below:

Title Page

Item (75) delete "Haughlin" and insert -- Hauglin --

Column 1

Lines 9-10, after "BACKGROUND OF THE INVENTION" delete "FIELD OF THE INVENTION" and insert the same on line 10 as a separate line.

Column 3

Line 26, delete "they," and insert --they--

Line 37, delete "engagment" and insert --engagement--

Column 4

Line 37 after "wherein" insert -- : --

Column 5

Line 30, delete "element.)" and insert -- element). --

Line 43, delete "or" and insert --of--

Column 7

Line 4, delete "11.)" and insert -- 11). --

Line 43, delete "or" and insert --of--

Line 64, delete "or" and insert --of--

Column 8

Line 25, delete "Known" and insert -- known --

Line 30, delete "aide" and insert --side--

UNITED STATES PATENT AND TRADEMARK OFFICE

CERTIFICATE OF CORRECTION

PATENT NO. : 6,986,526 B2
APPLICATION NO. : 10/297879
DATED : January 17, 2006
INVENTOR(S) : Hauglin It is certified that error appears in the above-identified patent and that said Letters Patent is hereby corrected as shown below:

Column 9

Line 8, after "as" delete "is" and insert --are--

Line 24, delete "204:" and insert --204;--

Column 10

Line 53, delete "slidaway" and insert --slideway--

Signed and Sealed this

Ninth Day of January, 2007

JON W. DUDAS
*Director of the United States Patent and Trademark Office*